US006364682B1

(12) United States Patent
Cappe

(10) Patent No.: US 6,364,682 B1
(45) **Date of Patent: *Apr. 2, 2002**

(54) ELECTRICAL CONNECTOR WITH LOW FORCE OF INSERTION PARTICULARLY WITH BLADE CONTACTS, FOR A FLEXIBLE CIRCUIT

(75) Inventor: Patrice Cappe, Faverolles (FR)

(73) Assignee: Framatome Connectors International, Courbevoie (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/378,103

(22) Filed: Aug. 20, 1999

(30) Foreign Application Priority Data

Aug. 24, 1998 (FR) ..... 98 10787

(51) Int. Cl.[7] ..... H01R 4/50; H01R 13/625
(52) U.S. Cl. ..... 439/341
(58) Field of Search ..... 439/341, 376, 439/495, 496

(56) References Cited

U.S. PATENT DOCUMENTS

| | | | | |
|---|---|---|---|---|
| 3,656,086 A | | 4/1972 | Debaigt | 439/362 |
| 4,428,636 A | | 1/1984 | Kam et al. | |
| 4,718,859 A | | 1/1988 | Gardner | 439/329 |
| 4,838,806 A | * | 6/1989 | Igarashi | 439/341 |
| 4,941,837 A | | 7/1990 | Nakamura | 439/341 |
| 5,772,459 A | * | 6/1998 | Swart | 439/341 |

FOREIGN PATENT DOCUMENTS

| | | |
|---|---|---|
| DE | 2351659 | 4/1974 |
| EP | 0244192 A1 | 11/1987 |

* cited by examiner

*Primary Examiner*—Brian Sircus
*Assistant Examiner*—Javaid Nasri
(74) *Attorney, Agent, or Firm*—Perman & Green, LLP

(57) ABSTRACT

An electrical connector with reduced insertion force comprising a base (10) provided with a blind recess (22) for receiving a plug (12). The base and the plug are connected to a flexible circuit (14, 16) of the type comprising a layer of electrical cables (18, 20). The electrical connector comprises sliding introduction guide means (38, 40) and means (84, 86) for locking in translation to permit a first orientation in which the plug can be displaced in translation and a second orientation in which the plug is immobilized by relative swinging of the plug and the base.

14 Claims, 5 Drawing Sheets

ELECTRICAL CONNECTOR WITH LOW FORCE OF INSERTION PARTICULARLY WITH BLADE CONTACTS, FOR A FLEXIBLE CIRCUIT

BACKGROUND OF THE INVENTION

The present invention relates to the field of electrical connectors so-called of low force of insertion or of zero force of insertion, more particularly applicable to so-called flexible circuits.

To connect the layers of flexible layers, users require connectors with a minimum of insertion force or locking force, the latter being of the locking type in translation and requiring above all avoiding untimely disconnection.

There is known for example a zero insertion force connector described in U.S. Pat. No. 4,718,859, provided to receive a layer of cables.

Such a connector comprises two blocks:

- a fixed block, generally connected to a support and provided for this purpose with blade contacts with a plug which are welded to the support, and
- a movable block which coacts with the fixed block to immobilize the cables of the layer and ensuring contact between the cables of this layer and the blades, this requiring no insertion effort of the layer.

The movable block is mounted on the fixed block by translatory movement, guide means ensuring a suitable positioning of the two parts. The layer is then inserted between the two blocks. It then suffices to pivot the movable block relative to the fixed block to ensure pressing one portion of the blades against the cables, thereby ensuring the electrical connection. The locking is simultaneously ensured because any displacement in translation of the movable block relative to the fixed block is prevented.

The problem solved by this patent is that of the variations of thicknesses of the various layers to be inserted in this connector. Thus, these variations give rise to loss of pressure force of the plugs of the fixed block on the cables of the layer, unless different models are provided, each applicable to a type of layer. Given the very low sales price of these connectors, it would be of interest to provide a same connector permitting receiving different thicknesses of layers of cables.

To solve this problem, the base blades described in this document of the prior art have a particular C-shaped profile at offset ends thereby forming two offset contact points, above and below the layer, with a pressure abutment carried by the movable block which ensures an S-shaped deformation of the layer when it is thin, so as to place it in contact at two points.

When the layer is thick, the contact pressure is obtained in the same manner but the layer remains substantially flat.

The use of such a connector is carried out successively by emplacing the movable block on the fixed block, by introduction of the layer and then by rotation of the movable block relative to the fixed block, with the result of ensuring the pressurizing of the cables of the layer against the base blades with a plug, particularly when the layer is thin.

SUMMARY OF THE INVENTION

The present invention has for its object a connector to connect two layers of cables or a layer of cables and a bundle of cables whose elements have simple stripped shapes permitting simultaneous placing in contact and locking, low production cost whilst offering the desired functions and particularly reduced insertion force, reliability of contact, wiping at the point of contact during connection in one of the modifications, and an absence of transmission of vibrations in another of the modifications.

The application provides a connector whose two male and female portions are already mounted on the layers or bundles of cables.

To this end, the electrical connector with reduced insertion force according to the invention comprises a base provided with a blind recess provided to receive a plug, this base and this plug being each connected to a flexible circuit particularly of the type comprising a layer of electrical cables, and is characterized in that the blind recess receives the stripped ends of the cables of the flexible circuit and comprises means for guiding slidably upon introduction, more particularly in the form of a ramp guide means opening on a locking hole and the plug comprises electrical contacts secured to the cables of the associated circuit as well as translatory locking means, more particularly in the form of at least one fixed rib, of a suitable profile to assume a first orientation in which it can be displaced in translation in said ramp and a second orientation in which it is immobilized in the locking hole by swinging relative to the plug in the base.

More particularly, there is provided:

- a blind recess in the base which comprises a plugging wall, a bearing wall facing it, two side walls for guidance and locking, each adapted to carry a ramp and a locking hole, the plugging wall making an angle a with the bearing wall, and
- the plug comprises an upper surface and a lower surface from which the electrical contacts project, these two surfaces being substantially parallel and provided to coact with the plugging and bearing walls and two lateral surfaces, each adapted to carry a rib.

According to embodiments, the layer of cables of the base is disposed against the bearing wall of the blind recess and lower surface of the plug is facing this bearing wall, or vice versa.

According to an arrangement of the invention, the rib of the plug has a width equal to the width of the base ramp and its longitudinal axis is inclined relative to the plane of the lower and upper surfaces of the plug by an angle a, such that the base and the plug are aligned after locking.

The electrical contacts of the plug are either blade contacts, the head of each blade forming a cross resiliently bearing against the corresponding cable of the layer during swinging, or full blade contacts, the head of each blade coming into contact with the corresponding cable of the layer by wiping.

For production reasons, a preferred embodiment provides that the base comprises a support plate for the layer, of the attached type, this blade comprising means to retain the flexible circuit and securement means on said base.

More particularly, the plate comprises two lateral returns provided with securement means on the side walls of the base and holding and positioning pegs, provided to coact with holes provided in ears provided during manufacture of the flexible circuit.

This electrical connector comprises, according to an improvement, locking means upon swinging, provided with a ring slidably mounted on the upper end of the block of the plug and provided with two lateral profile positioning tongues adapted to penetrate each into the groove and corresponding ramp.

BRIEF DESCRIPTION OF THE DRAWINGS

The present invention will now be described in detail according to a particular non-limiting embodiment, in connection with the accompanying drawings, in which the different figures show.

DETAILED DESCRIPTION OF THE INVENTION

Figure 1A:
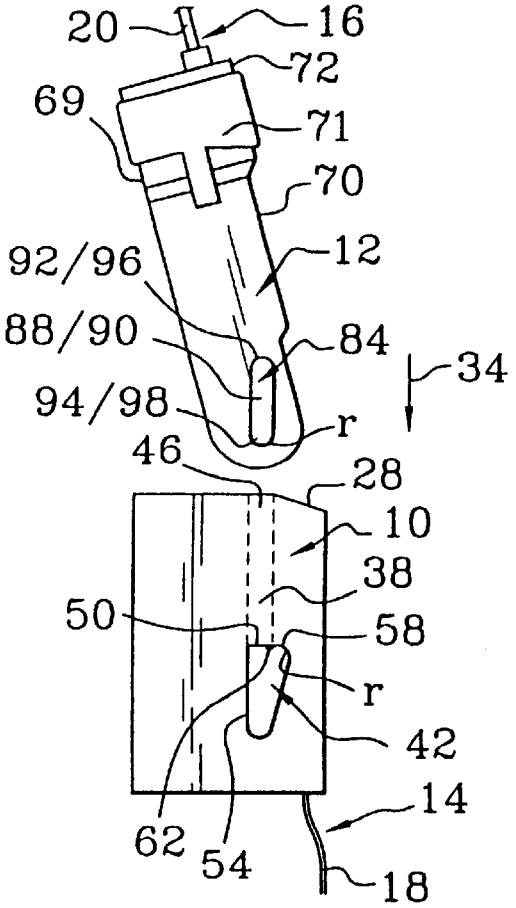
FIGS. 1A, 1B and 1C, a sequence of the connection phases of a plug and a base of a connector according to the present invention, the elements being seen in side elevation, this assembly being provided with a double locking improvement, FIGS. 2A, 2B and 2C, a sequence identical to the preceding one, the elements being seen in medium transverse cross-section, FIGS. 3A and 3B, a first modification showing a support plate for a flexible circuit with spring effect, such as is connected to the base, in elevation and in cross-section, FIG. 3C being a detail of the support of the flexible circuit, FIGS. 4A and 4B, a second modified embodiment showing a support plate for the flexible circuit with a double acting spring, as given in elevation and cross-section, FIG. 4C being a detail of the support of the flexible circuit, FIGS. 5A, 5B and 5C, a sequence of connection of a third embodiment, so called by wiping.

In FIGS. 1A, 1B, 1C and 2A, 2B and 2C, there is shown a first embodiment of a connector comprising a base 10 and a plug 12, respectively connected to the end of a flexible circuit 14 and 16 comprised by a layer and/or a bundle of electrical cables 18 and 20.

According to this first embodiment, the base comprises a blind recess 22 for reception of the plug.

This recess 22 comprises:

a plugging wall 24, a bearing wall 26, opposite the plugging wall, two lateral guide walls 28 and 30, only the wall 28 being visible, the other being facing it, and a bottom 32.

The plugging wall 24 is inclined at an angle $\alpha$, of the order of 10 to 20°, relative to the direction of introduction of the plug 12, shown by the arrow 34. Moreover, this plugging wall is connected to the bottom by hollow forming an arc of a circle of radius R.

The bearing wall 26 is parallel to the direction of introduction of the plug and carries on a portion of its surface the stripped cables 18 of the corresponding layer 14. An abutment 36 permits limiting penetration of the cables and ensuring optimum positioning.

Each of the side walls 28 and 30 is provided with guide and locking means 37, comprising two guide ramps or grooves 38, 40, each in the form of a groove provided in the plane of the wall and two holes 42, 44, for obvious reasons of symmetry and stability. One 46, 48 of the ends of each of the ramps opens at the edge of the blind recess 22 whilst the other 50, 52 of the ends opens downwardly in the corresponding hole 42, 44.

The holes 42, 44 have a particular profile, substantially in the shape of a right triangle. Each large side 54, 56 of the right angle is aligned with the edge of the corresponding ramp 38, 40, which is on the side of the plugging wall 24.

Each small side 58, 60 is of a length greater than the width of the corresponding groove constituting the ramp. Each small side comprises moreover a locking boss 62, 64 projecting into the corresponding hole 42, 44.

Apart from the right angle, the two other angles are provided with a hollow, of a same radius r, in the present case.

The bottom 32 is provided with a through slot 66, through which the flexible circuit is adapted to pass.

The plug 12 comprises a block 68 of a shape partially conjugated with that of the blind recess 22 of the base and whose upper surface 69 and lower surface 70 are substantially parallel, with two side guide surfaces 71, 72.

In known manner, this block 68 comprises a slot 73 for reception of a flexible circuit 16 comprising a bundle of electrical cables 20. The conductive portion of each cable is prolonged in the juxtaposed sockets 74. Each socket is provided with a hole 75 for passage of an electrical contact 76 in the form of a blade, each comprising a foot 78 and a head 80, and maintained in gaps 77 provided in each block. Each contact 76 can have two positions, one, before mounting, in which the foot 78 of the contact is outside the socket and the other, after mounting, in which the foot 78 of the contact projects into the socket 74 to penetrate the conductive portion of the corresponding cable and to ensure electrical connection. The foot is generally provided with barbs which prevent retraction of each blade contact outside its recess after mounting.

In this embodiment, the head 80 of each contact 76 is in the form of a cross 82 whose free end is linear, which permits providing a return effect.

The plug also carries a portion of the guide and locking means 37 in the form of two ribs 84, 86. Each rib comprises a rectilinear portion 88, 90 of a width equal to the width of the ramps of the base, for sliding contact, and of a length equal to that of the larger side 54, 56 of the hole 42, 44. The two ends 92, 94; 96, 98 of each rib are rounded with a radius of curvature equal to r, as for the hollows of the angles of the holes.

Moreover, the longitudinal axis of the rib also makes an angle $\alpha$ with the longitudinal axis of the block 68 whose four faces are substantially parallel two by two. As to end of the block, it is rounded with a radius R identical to the radius R of the hollow between the plugging wall 24 and the bottom 32.

Such a conductor is used in the following manner.

Figure 2A:
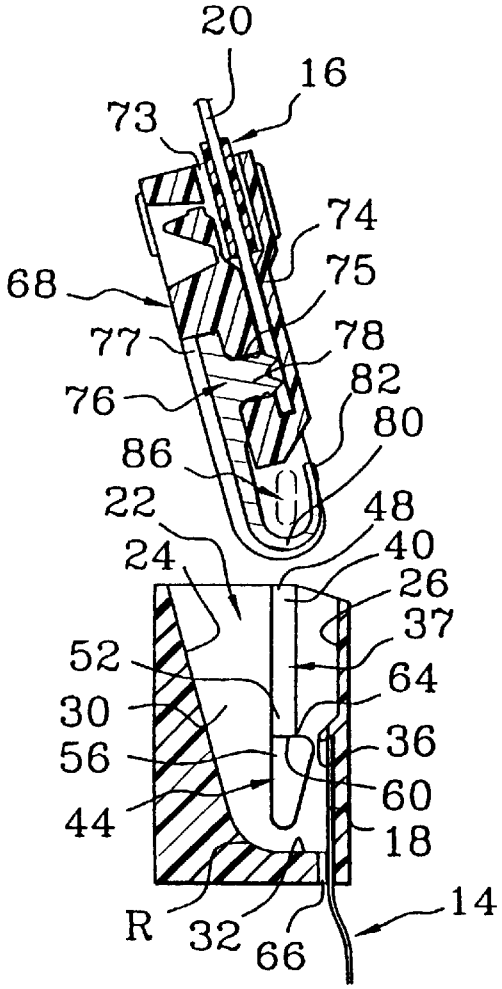

Once the flexible circuits and other cable bundles are connected to the base and the plug, the plug is presented as indicated in FIGS. 1A and 2A, which is to say with the longitudinal axis of the rib parallel to the direction of introduction indicated by the arrow 34. Because of this, the block is inclined at an angle $\alpha$ such that the upper surface is parallel to the plugging wall 24. The rib is positioned in the corresponding ramp, which permits, without force, inserting the plug into the base by translation, until the block comes to bear against the plugging wall, the end of the block being then in contact with the bottom 32 of the blind recess of the base. More particularly, the end of the block coacts with the hollow of radius B provided between the plugging wall and the bottom. It is then in the position shown in FIGS. 1B and 2B.

Figure 1B:
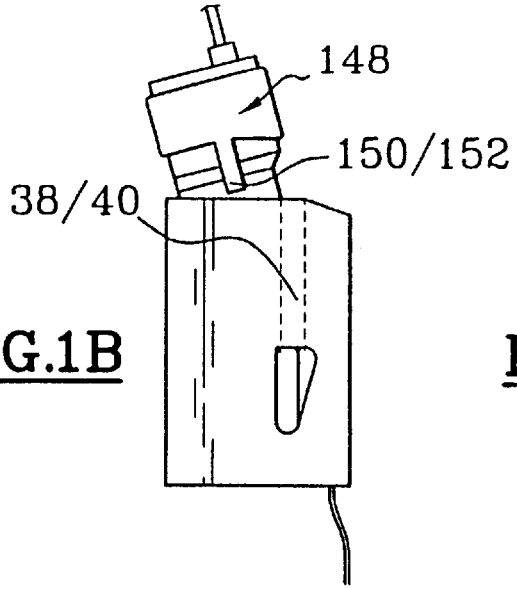
Figure 2B:
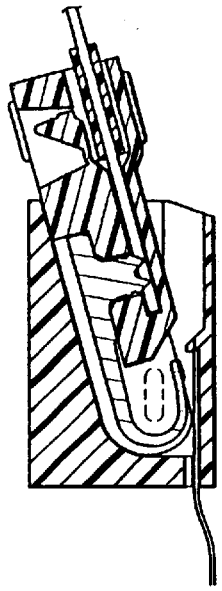
Figure 1C:
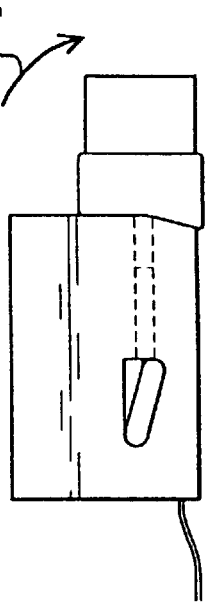
Figure 2C:
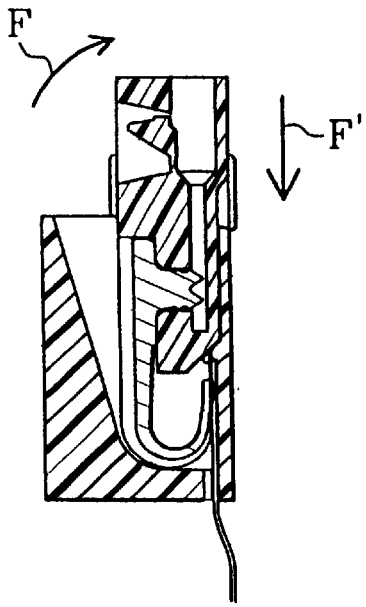

To reach the position shown in FIGS. 1C and 2C, it is necessary to swing the plug relative to the base in the direction of the arrow F, which maneuver is also carried out with very low force and with a good locking sensation, thanks to the locking bosses.

This swinging action has several results.

In the first place, the rectilinear portion 82 of the head 80 in the form of a cross of each contact 76 with a blade of the plug comes into contact by pressing against the conductors 18 of the layer 14 of the base, because of the elasticity imparted by the cross.

Then, each rib 84, 86 pivots in the corresponding hole 42, 44 and is blocked in this same hole, on the other side of the locking boss 62, 64 which constitutes a light hard point. The plug 12 has its longitudinal axis and its lower surface 70 parallel to the bearing wall 26 of the base whilst the longitudinal axis of the rib is inclined at an angle α with respect to the direction of introduction. Because of this, each rib is blocked in the corresponding hole, preventing any extraction by translation of the plug from the base.

It will be noted that in this embodiment, the resilient bearing region of the blade contacts on the flexible circuit permits localizing the contact pressure at the level of each of the points of electrical connection. It will also be noted that this resilient bearing avoids the transmission of vibrations in the blade and hence the movements of the foot by unhooking the barbs that hold it relative to the block.

Figure 3B:
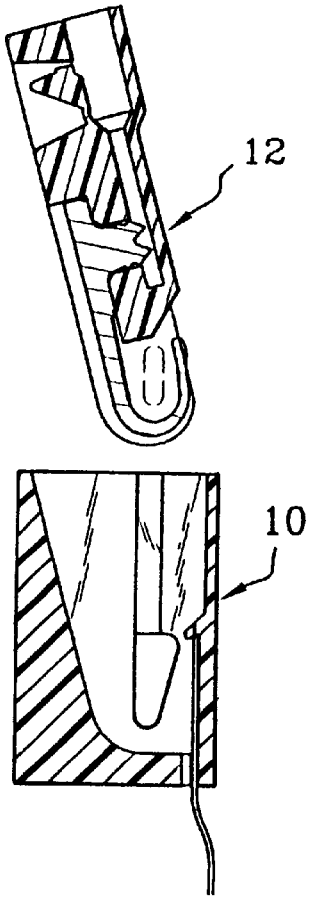
Figure 3A:
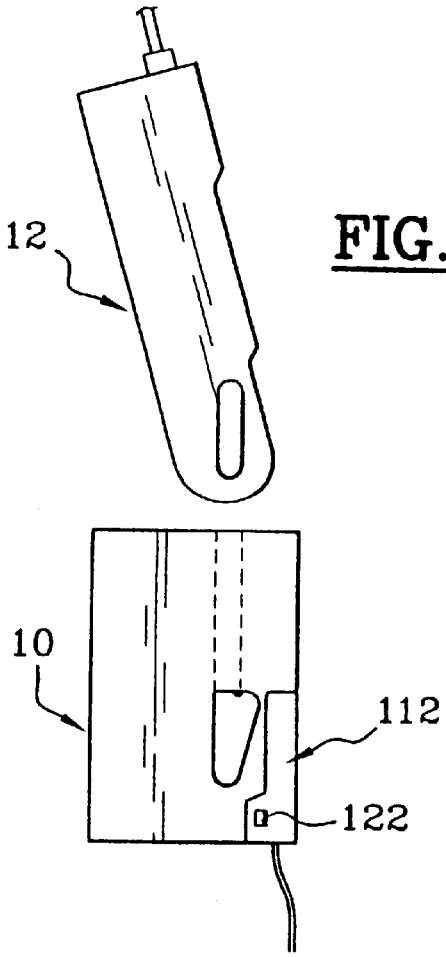
Figure 3C:
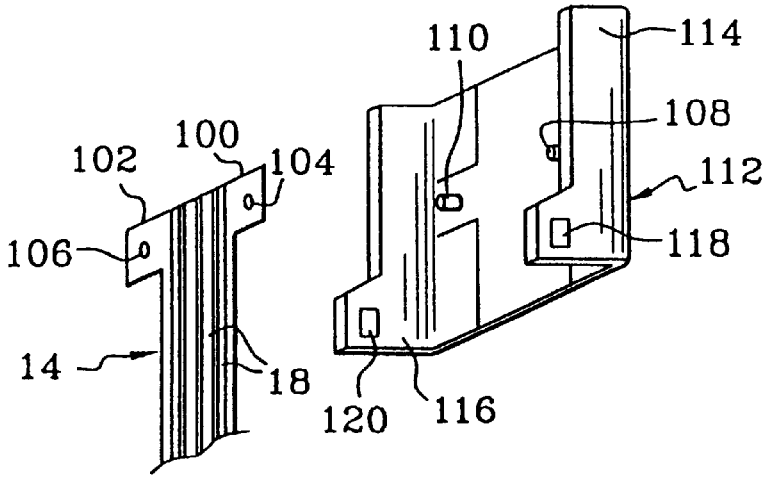

In FIGS. 3A, 3B and 3C, there is shown a first embodiment of the securement of the flexible circuit 14 on the base.

The flexible circuit comprises, as shown in FIG. 3C, two ears 100, 102 in which are provided two holes 104, 106 provided to coact with the holding and positioning pegs 108, 110 secured to a plate 112. This plate comprises two wings 1 14, 1 16 with holes 1 18, 120 which coact with the pegs manufactured with the base, such as 122, the only one visible. This plate is of a suitable shape to integrate into the base.

Figure 4B:
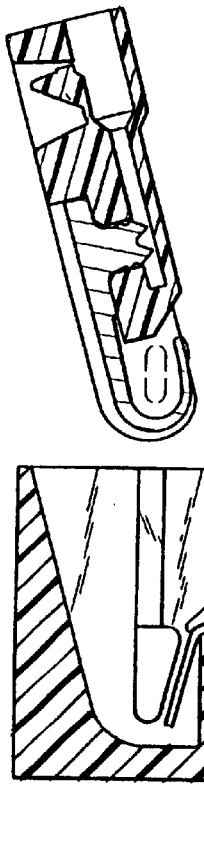
Figure 4A:
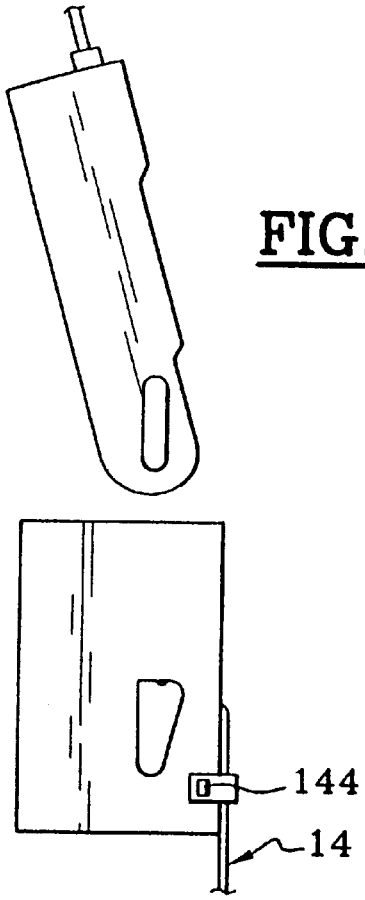
Figure 4C:
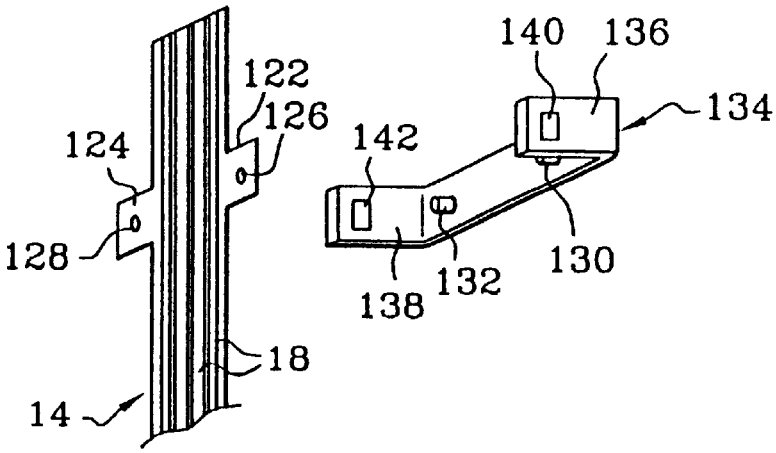

Another modified mounting of the flexible circuit is shown in FIGS. 4A, 4B and 4C. In this case, the securement is external with a double spring effect. Thus, the flexible circuit comprises two ears 122, 124 in which are provided two holes 126, 128 provided to coact with pegs 130, 132, for holding and positioning, secured to a plate 134. This plate comprises two wings 136, 138 with holes 140, 142 which coact with lugs provided during manufacture of the base, such as 144, the only one visible. The base is moreover provided with a slot 146, instead of and in place of the slot 66 provided in the base of the blind recess 22. The flexible circuit is thus introduced through this slot, with a portion passing beyond, of a suitable length, the layer projecting into the blind recess, substantially parallel to the bearing wall.

Figure 5C:
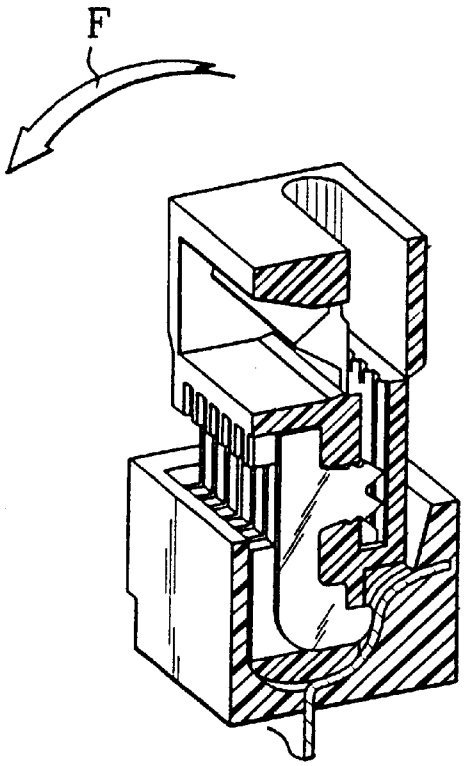
Figure 5B:
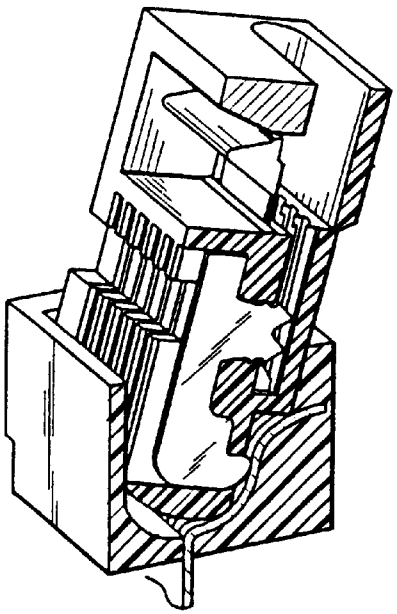
Figure 5A:
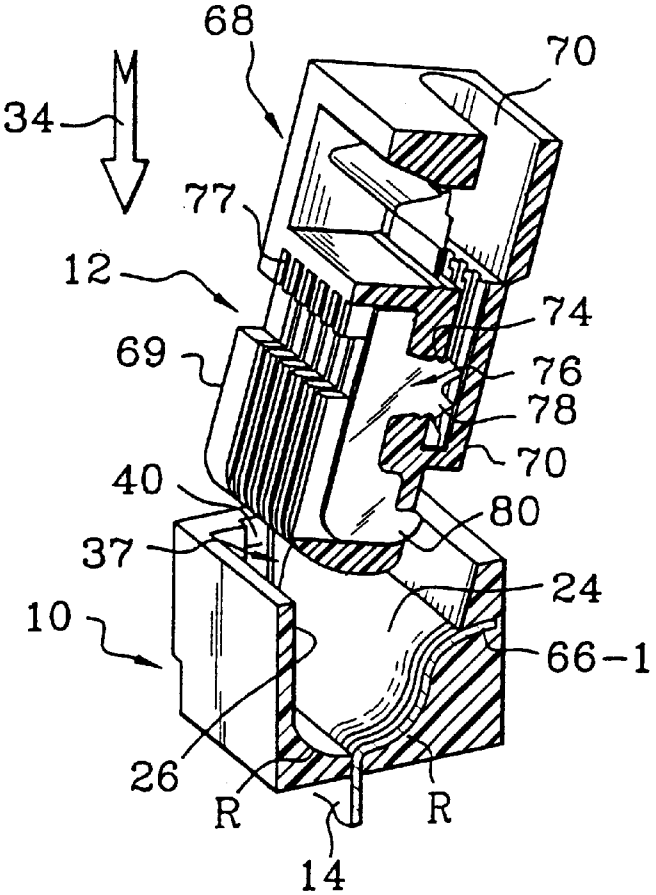

What is shown in FIGS. 5A, 5B and 5C permits appreciating the external shape of the plug and the base and shows a modified embodiment with full contact blades.

In this case, identical elements have the same reference numerals as in FIGS. 1A, 1B and C; 2A, 2B and 2C.

The difference in the plug is principally in line with the head 80 of the electrical contact 76 in the form of a blade. The resilient cross is omitted for a full head, which accordingly is rigid. The head has a rounded end with a radius of curvature R, to simplify production and ensure good electrical.

The difference as to the base is the position of the flexible circuit 14 which is introduced through the slot 66 of the bottom, but which is positioned on the plugging wall, a blind supplemental slot 66-1 is provided in this wall to ensure good holding of this circuit. Moreover, there is provided another hollow of radius R between the bottoms 32 and the bearing wall.

The emplacement of the plug in the base is entirely identical to the preceding embodiments, by means of turning the plug by 180°, the ribs being oriented suitably to coact with the associated holes. Thus, the upper surface 69 is now facing the bearing wall 26 of the base.

There will be noted a supplemental effect called wiping, because, upon introduction of the plug, the head of each electrical contact 76 is brought into contact with the corresponding stripped cable of the flexible circuit, then during swinging movement of the plug relative to the base, the head 80 of each electrical contact 76 scrapes against the cable and thereby ensures improved electrical contact.

The plug and the base are then secured as in the preceding embodiments.

In all the embodiments, the plug and the base are aligned after locking, in the working position, which is preferable, the insertion taking place by translation, the plug and the base forming an angle α. The same functions are obtained with an introduction position in which the plug and the base are aligned and a locked position with these two elements making an angle α.

Similarly, according to a modification of the present invention, it is possible to provide the locking bosses 62, 64 on the rib and a hollow provided in the small side of the associated hole 42, 44, provided each to receive one of the bosses. The bosses could also be carried laterally by the rib or by the wall of the blind recess with a hollow face to face.

The connector according to an improvement of the present invention could be provided with a second locking means. These second locking means ensure immobilization of the plug relative to the base upon swinging. These second means comprise a ring 148 mounted slidably on the upper end of the block 68 of the plug and provided with two lateral tongues 150, 152 of a shape and a position suitable to penetrate each one into the groove of the corresponding ramp 38, 40.

As is indicated in FIGS. 1A, B, C and 2A, B, C, the ring is in the upper position during insertion and swinging movements, and after swinging the ring is lowered in the direction of the arrow F', to cause the tongues to penetrate the corresponding grooves, which ensures against swinging the plug relative to the base, which therefore prevents any retraction in translation of the plug relative to the base and resulting disconnection.

What is claimed is:

1. An electrical connector with reduced insertion force comprising a plug and a base (10) provided with a blind recess (22) to receive said plug (12), the base and the plug each being connected to a corresponding flexible circuit (14, 16) comprising a layer of electrical cables (18, 20), characterized in that the base comprises means (38, 40) for introducing and guiding the plug comprising at least one guide groove formed in the base, and the plug has means (84, 86) for slidably locking the plug relative to the base, the means on the plug being conjugally received in the guide groove to permit sliding between the means on the plug and base and restrain the plug in a first orientation relative to the base in which the plug is displaced in translation when the plug is inserted into the base, and the at least one guide groove has an end against which the means on the plug rests to stop the insertion of the plug, wherein when the means on the plug rests against the end of the at least one groove the means of the plug in the at least one groove is turnable relative to the at least one groove, and the plug is free to rotate relative to the base from the first orientation to a second orientation in which the plug is prevented from being withdrawn from the base, and wherein the blind recess receives stripped ends of the layer of cables of the corresponding flexible circuit.

2. The electrical connector according to claim 1, characterized in that:

the means on the base comprise at least one locking hole (42, 44) provided in the base into which opens the at least one guide groove so that the hole forms the end of the at least one guide groove, and the means on the plug comprise at least one fixed rib (84, 86) carried by the plug (12), wherein the plug comprises electrical contacts (76) secured to the layer of cables (20) of the corresponding flexible circuit (16), each rib having a profile so that when the rib is inserted in the at least one guide groove of the base, the rib is held in an aligned orientation with the guide groove in which the rib can be displaced in translation along said at least one guide groove, the aligned orientation of the rib and at least one guide groove corresponding to the plug being in the first orientation, and when the plug is rotated relative to the base from the first orientation to the second orientation the rib is turned in the locking hole relative to the at least one guide groove so that the rib is oriented at an angle relative to the guide groove.

3. The electrical connector according to claim 2, characterized in that:

the blind recess (22) of the base comprises a plugging wall (24), a bearing wall (26) facing the plugging wall, two side guide and locking walls (28, 30), the at least one guide groove and locking hole being formed in one of the two side walls, a second of the two side walls having another guide groove and locking hole therein, the plugging wall (24) making an angle($\alpha$) with the bearing wall (26), and the plug (12) comprises an upper surface (69) and a lower surface (70) from which project the electrical contacts (76), the upper and lower surfaces being substantially parallel to each other and provided to coact with the plugging and bearing walls (24, 26), and two side surfaces (71, 72) the at least one rib depending from one of the two side surfaces, and a second rib depending from another of the two side surfaces.

4. The electrical connector according to claim 3, characterized in that the layer (14) of cables (18) of the base (10) is disposed against the bearing wall (26) of the blind recess (22) and in that the lower surface (70) of the plug is facing this bearing wall.

5. The electrical connector according to claim 4, characterized in that the layer (14) of cables (18) of the base (10) is disposed against the plugging wall (24) of the blind recess (22) and in that the lower surface (70) of the plug faces this plugging wall.

6. The electrical connector according to claim 3, characterized in that the at least one rib (84, 86) of the plug (12) has a width equal to the width of the at least one guide groove (38, 40) of the base, and in that a longitudinal axis of the rib is inclined relative to a plane of the upper and lower surfaces (69, 70) of the plug by an angle ($\alpha$), such that the base and the plug are aligned relative to each other after locking.

7. The electrical connector according to claim 3, characterized in that the plug comprises rotation locking means for preventing rotation of the plug relative to the base from the second orientation when the rotation locking means on the plug are engaged.

8. The electrical connector according to claim 7, characterized in that the rotation locking means comprise a ring (148) mounted slidably on an upper end of the plug (12), and two lateral tongues (150, 152) depending from the ring of a shape and position to penetrate each one into corresponding grooves of the ramp (38, 40).

9. The electrical connector according to claim 1, characterized in that electrical contacts (76) of the plug (12) are resilient blade contacts, a head (80) of each blade resiliently bearing against a corresponding cable (18) of the layer (14) of cables when the plug is rotated relative to the base from the first orientation to the second orientation.

10. The electrical connector according to claim 1, characterized in that electrical contacts (76) of the plug are full blade contacts, a head (80) of each blade coming into contact with a corresponding cable (18) of the layer (14) of cables by wiping against the corresponding cable when the plug is rotated relative to the base from the first orientation to the second orientation.

11. The electrical connector according to claim 1, characterized in that the base (10) comprises a support plate (112, 134) for the layer of cables of the corresponding flexible circuit, the support plate comprising means (108, 110; 130, 132) to retain the flexible circuit on the support plate and means (118, 120, 140, 142) for securement of the support plate on said base.

12. The electrical connector according to claim 11, characterized in that the support plate comprises two side wings (114, 116; 136, 138) provided with holes for engaging securement means on the side walls of the base, and holding and positioning pegs provided to coact with holes (104, 106; 126, 128) provided in ears (100, 102; 122, 124) of the flexible circuit to attach the flexible circuit to the support plate.

13. A low insertion force electrical connector comprising:

a base having a plug receiving recess formed therein; and a plug adapted to be received in the plug receiving recess of the base when the plug is connected to the base;

wherein the base has at least one guide groove formed therein with a slot portion and an aperture at one end of the slot portion, the slot portion being aligned longitudinally with a direction of insertion of the plug into the recess, and the plug has a slide member projecting therefrom sized and shaped to be received in the slot portion of the guide groove and to slide freely in the guide groove in the direction of insertion when the plug is inserted into the recess, the slide member being slidably captured in the slot portion for holding the plug in a first orientation relative to the base when the plug is inserted into the recess, and when the slide member enters into and engages the aperture at the end of the slot portion, the slide member is turnable within the aperture and the plug is free to rotate relative to the base from the first orientation to a second orientation, and wherein the plug has means for locking the plug to the base when the plug is in the second orientation, the means for locking the plug to the base comprising a ring slidably mounted on the plug, the ring being moved against the base to lock the plug to the base and prevent the plug from being rotated relative to the base from the second orientation to the first orientation.

14. The electrical connector in accordance with claim 13, wherein when the plug is in the second orientation, the slide member on the plug and the slot portion of the guide groove in the base form an interference preventing extraction of the plug from the base.

* * * * *